United States Patent [19]

Forth et al.

[11] Patent Number: 4,953,359

[45] Date of Patent: Sep. 4, 1990

[54] METHOD OF ADAPTING A TWO-STAGE REFRIGERATOR CRYOPUMP TO A SPECIFIC GAS

[75] Inventors: Hans-Joachim Forth; Hans-Ulrich Häfner, both of Köln, Fed. Rep. of Germany

[73] Assignee: Leybold Aktiengesellschaft, Köln, Fed. Rep. of Germany

[21] Appl. No.: 338,606

[22] Filed: Apr. 14, 1989

[30] Foreign Application Priority Data

Apr. 22, 1988 [EP] European Pat. Off. ..... 88106497

[51] Int. Cl.[5] ..... B01D 8/00

[52] U.S. Cl. ..... 62/55.5; 55/269; 417/901

[58] Field of Search ..... 62/55.5, 100, 268; 417/901; 55/269

[56] References Cited

U.S. PATENT DOCUMENTS

| | | | |
|---|---|---|---|
| 4,438,632 | 3/1984 | Lessard et al. | 62/55.5 |
| 4,614,093 | 9/1986 | Bächler et al. | 62/55.5 |
| 4,667,477 | 5/1987 | Matsuda et al. | 62/55.5 |
| 4,679,401 | 7/1987 | Lessard et al. | 62/55.5 |
| 4,757,689 | 7/1988 | Bachler et al. | 62/55.5 |

FOREIGN PATENT DOCUMENTS

| | | |
|---|---|---|
| 0126909 | 12/1984 | European Pat. Off. . |
| 1508542 | 1/1968 | France . |
| 1553094 | 1/1969 | France . |
| 2572794 | 5/1986 | France . |
| 8203993 | 11/1982 | PCT Int'l Appl. . |
| 8400404 | 2/1984 | PCT Int'l Appl. . |

*Primary Examiner*—Ronald C. Capossela
*Attorney, Agent, or Firm*—Spencer & Frank

[57] ABSTRACT

The invention relates to a method of adapting a two-stage refrigerator cryopump to a specific gas; the cryopump includes a first cooling stage to which pump surfaces are fastened and which is equipped with a heating device; the cryopump further includes a second cooling stage to which pump surfaces are fastened and which, during operation, takes on a temperature of up to 20 K. In order to enable the pump to perform at an optimum level for gases having different vapor pressures, it is proposed to control the heating device in such a manner that the coldest location of the first cooling head or, more precisely, of its pump surfaces, has a temperature which is higher by 5 to 10 K than the vapor pressure temperature of the respective gas associated with the maximum process pressure.

11 Claims, 5 Drawing Sheets

METHOD OF ADAPTING A TWO-STAGE REFRIGERATOR CRYOPUMP TO A SPECIFIC GAS

BACKGROUND OF THE INVENTION

The invention relates to a method of adapting a two-stage refrigerator cryopump to a specific gas; the cryopump includes a first cooling stage to which pump surfaces are fastened and which is equipped with a heating device; additionally the cryopump includes a second cooling stage to which pump surfaces are fastened and which, during operation, takes on a temperature between about 10 and 20 degrees K. The invention further relates to cryopumps suitable for implementing this method.

In cryopumps of this type, gases are captured primarily by employing the physical processes of "adsorption" and "condensation." Due to these processes, an unconditioned, two-stage refrigerator cryopump pumps without problems in all pressure ranges below $10^{-2}$ mbar, as long as the occurring gases can be grouped into three classes:

(a) adsorbable gases ($H_2$, Ne, He) at $T \leqq 20$ degrees K. on adsorption surfaces;

(b) first condensable gases ($N_2$, $O_2$, Ar) at $T \leqq 20$ degrees K.;

(c) second condensable gases (typically: $H_2O$) at $T \leqq 150$ degrees K.

While for the operation of a second stage cryopump $T_2 \leqq 20$ degrees K. is practically an operational requirement, the first stage is able to set itself within a broad range from about 50 degrees K. to 150 degrees K., depending on the size and type of the pump, the process and the external loads.

These circumstances are without a direct effect when pumping gases such as water vapor but may be of special importance for the occurrence of gases having vapor pressure curves between that of $H_2O$ and that of $O_2$ and $N_2$. Examples for such gases are CO, $N_2O$, $CH_4$, etc. The situation becomes particularly critical if these gases are present under varying pressure conditions ($10^{-3}$ to $10^{-7}$ mbar). A gas particle entering the cryopump is condensed on its path within the cryopump at the first location which is just cold enough to bind the particle. From the vapor pressure curve of the respective gas it can be seen that, for example, a lower temperature is required to bind a gas at a pressure of $\leqq 10^{-7}$ mbar than at a pressure of $10^{-3}$ mbar. Gases whose vapor pressure curves lie between the above-mentioned first condensable gases and the second condensable gases are therefore able to be condensed at an initially higher process pressure at sufficiently cold locations of the first stage. If one then desires to go toward lower pressures, this sometimes is not successful since the first stage is not cold enough for this purpose. At a pressure between $10^{-3}$ and $10^{-7}$ mbar, the gas that previously started to freeze in the first stage slowly travels over to the second stage, i.e. the pressure remains at an intermediate level; the pump no longer appears to be pumping.

European Patent No. 126,909 discloses the provision of a passive heat load for the pump surfaces of the first stage in that the outer surface of the radiation shield is blackened. Although the temperature of the first stage can be raised to a level which lies above a certain temperature by a passive load of this type, it is not possible to maintain a fixed temperature value. With increasing load on the pump, the temperature of the constantly loaded first stage which is relatively high in any case will rise to such an extent that it has a negative influence on the effectiveness of the pumping behavior. Moreover, the passive load cannot be changed so that a cryopump equipped with such a load may be suitable, for example, for pumping argon, but is no longer suitable for gases having higher vapor pressures. With such gases, the above-described rearrangements continue to occur. Another drawback of the passive load is that it is always present and thus extends the time required for the cryopump to reach the desired cold temperature.

SUMMARY OF THE INVENTION

It is the object of the present invention to provide a method of the above-mentioned type as well as a cryopump for implementing this method which permits optimum pumping behavior for gases having different vapor pressures and in which the time required to reach the desired cold temperature is not adversely influenced.

This is accomplished according to the invention in that the heating device of the first stage is controlled in such a manner that the coldest location of the first cooling stage or, more precisely, of its pump surfaces, takes on a temperature which is higher by about 5 to 10 degrees K. than the temperature at which the vapor pressure of the respective gas is just equal to the highest occurring process pressure. These measures make it possible to easily keep the temperature of the pump surfaces of the first stage precisely constant within ±2 K. Additionally, the temperature of the first stage can be varied so that each pump type can be adapted in the same manner to each process gas. The measures according to the invention do not have an adverse influence on the time required to reach the desired cold temperature since the control starts only at the desired temperature. Moreover, the temperature of the first stage can be kept constant independently of varying external loads since an increase in the external load results in a corresponding reduction of heating output. Finally, the temperature control according to the invention can be employed to observe the load state of the pump. The greater the load, the less frequently the heating device switches on. Generally speaking, the actively controlled heating load also stabilizes the pump relative to alternating external loads.

Other advantages and details of the invention will be described with reference to embodiments that are illustrated in the drawings.

DETAILED DESCRIPTION OF THE PREFERRED EMBODIMENT

Figure 1:
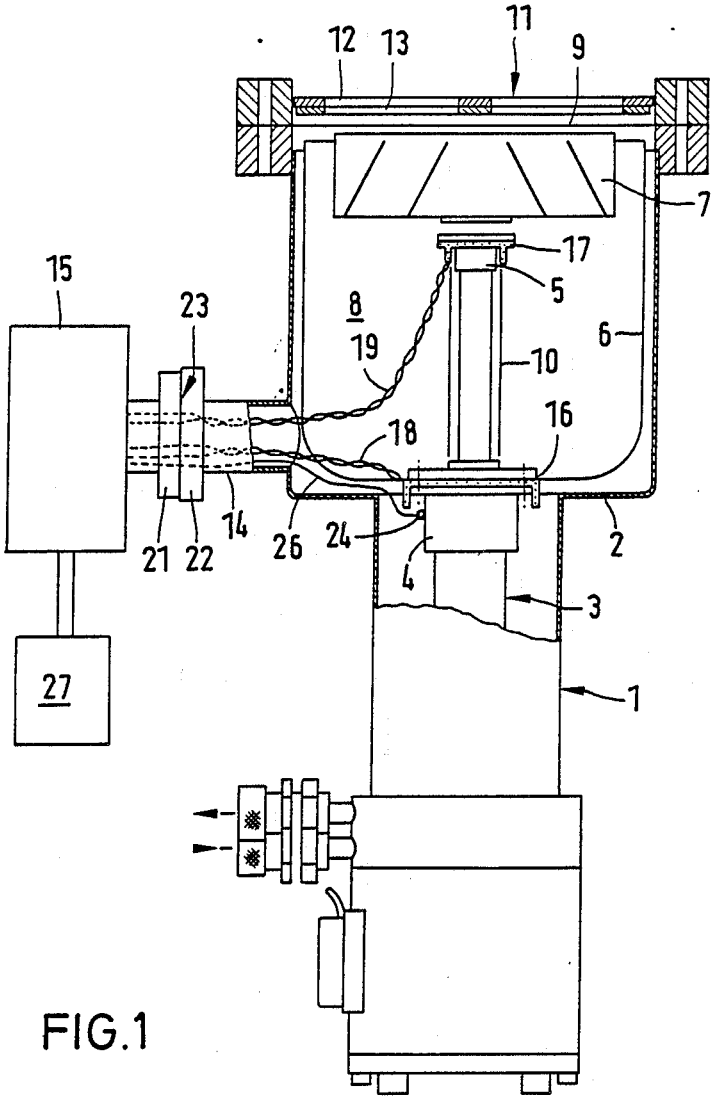
FIG. 1 is a schematic, side sectional view of a cryopump according to the invention.

The cryopumps 1 and their housings 2 shown in FIG. 1 and FIGS. 3–8 each include a two-stage refrigerator cooling head 3 (shown only in part), whose cooling stages are marked 4 (first stage) and 5 (second stage). The pot-shaped pump surface and its shielding 6 are fastened to the first stage 4 so as to provide for good heat conduction, with the pump surface together with a baffle 7 supported by shielding 6 enclosing the interior 8 of the pump. In the interior 8, there are disposed pump surfaces 10 of the second stage which are connected with the second cooling stage 5 so as to provide for good heat conduction. A valve 11 shown only in FIG. 1 is disposed upstream of a pump inlet opening 9 which is equipped with a baffle 7. Valve 11 includes the fixed disc 12 and a rotatable disc 13, each provided with essentially radial slotted openings. The valve is actuated by rotation of disc 13.

In the embodiment according to FIG. 1, housing 2 of cryopump 1 is provided, approximately at the level of stage 4 of the first refrigerator stage, with a pipe connection 14 which supports a monitoring device marked 15. This device comprises a circuit for supplying heating devices 16 and 17 with which cooling heads 4 and 5 of the two-stage cooling head 3 are equipped. A vacuum-tight passage 23 is provided for connecting lines 18 and 19 between supply device 15 and heating devices 16, 17 in the region of flanges 21, 22 at supply device 15 and at pipe connection 14, respectively.

Additionally, the cryopump includes a temperature sensor 24 which is provided at cooling stage 4 and whose measuring line 26 also leads to monitoring device 15. A supply unit 27 shown as a block is connected with this monitoring device 15. In addition to its function as an excess temperature protection during regeneration by means of electrical heaters, the monitoring device 15 serves to ensure the setting of the desired temperature of cooling stage 4 and of the pump surfaces and shieldings 6, 7 supported thereby.

For this purpose, the temperature of cooling stage 4 is measured with the aid of sensor 24. This measured value is fed to monitoring device 15. There the measured value is compared with a desired value depending on the gas to be pumped. If the temperature of the cooling head lies below this desired value, heating device 16 switches on until the desired temperature has been reached and then it turns off again, etc.

Figure 2:
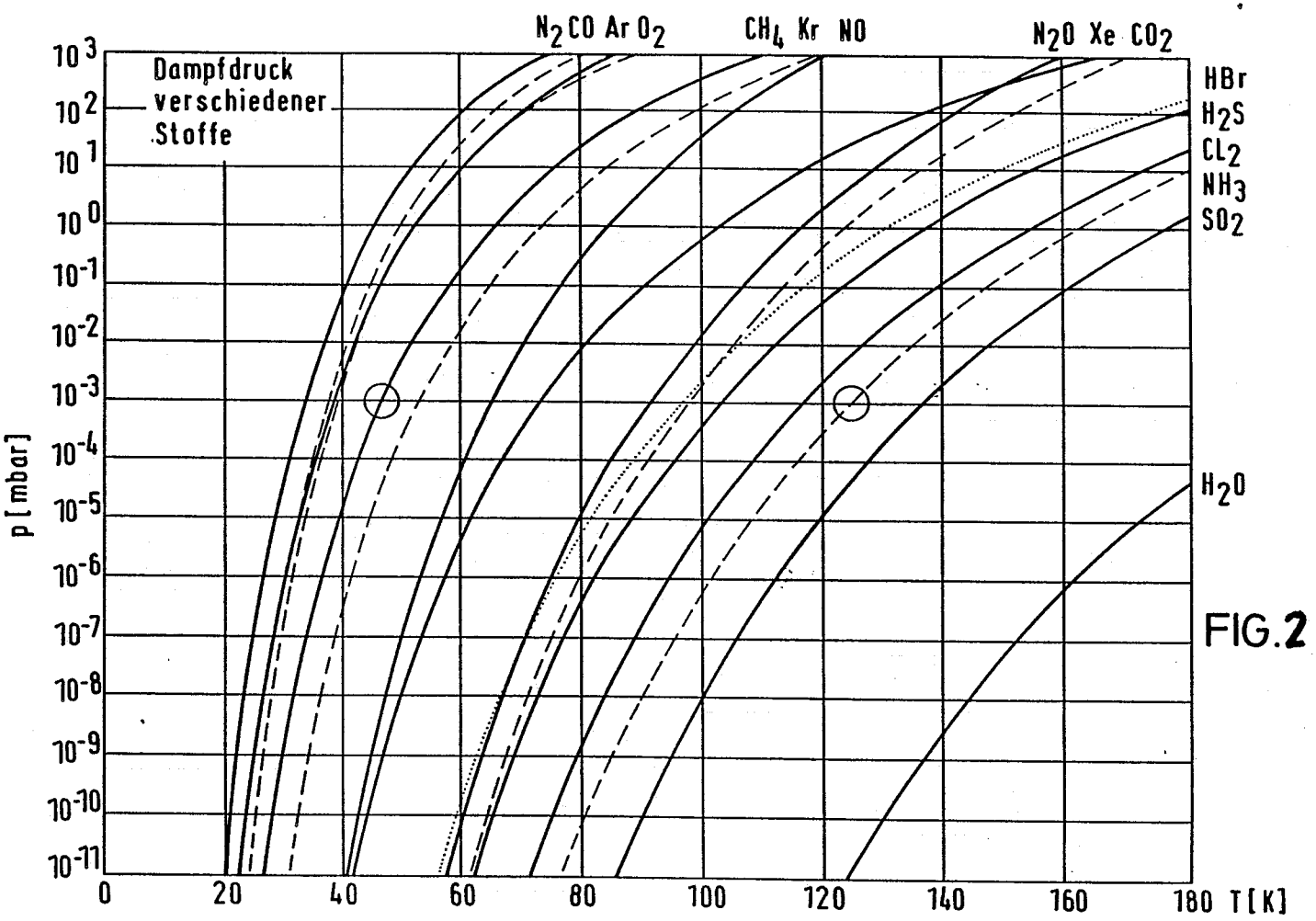
FIG. 2 is a vapor pressure diagram of various gases which can be pumped by the cryopump of FIG. 1.

FIG. 2 shows the vapor pressure curves of various gases. Since, according to the teaching of the invention, the heating device must be controlled in such a manner that the coldest location of the first cooling stage or, more precisely, of its pump surfaces, has a temperature which is higher by 5 to 10 K. than the vapor pressure temperature of the gas to be pumped corresponding to the highest process pressure, the respective desired temperature to be set can be read from the illustrated family of curves. The process gases generally (e.g. in sputter processes) are initially available at a pressure of a few $10^{-3}$ mbar. The $10^{-3}$ mbar line intersects the illustrated vapor pressure curves. Thus, the temperature to be set is a value which lies by 5 to 10 K. to the right of the point of intersection of the $10^{-3}$ mbar line with the associated vapor pressure curve. If, for example, $CH_4$ is to be pumped, the temperature of the first stage or, more precisely, of its pump surfaces, must be set to a value of about 55 to 60 K. If, preferably, $NH_3$ is to be pumped, a temperature must be selected which lies at approximately 130 to 135 K. With such a temperature selection, it is ensured that the respectively considered gas will not accumulate in the first pump stage but will be pumped directly by the pump surfaces of the second stage. Rearrangements which interfere with a pressure reduction during later pumping to $<10^{-3}$ mbar, no longer occur.

In the embodiment according to FIG. 1, both pump stages are equipped with a heating device 16, 17. They serve—in addition to setting the temperature of cooling stage 4 by way of heating device 16—to regenerate the pump surfaces of both stages in that these pump surfaces are heated to room temperature.

Figures 3, 4:
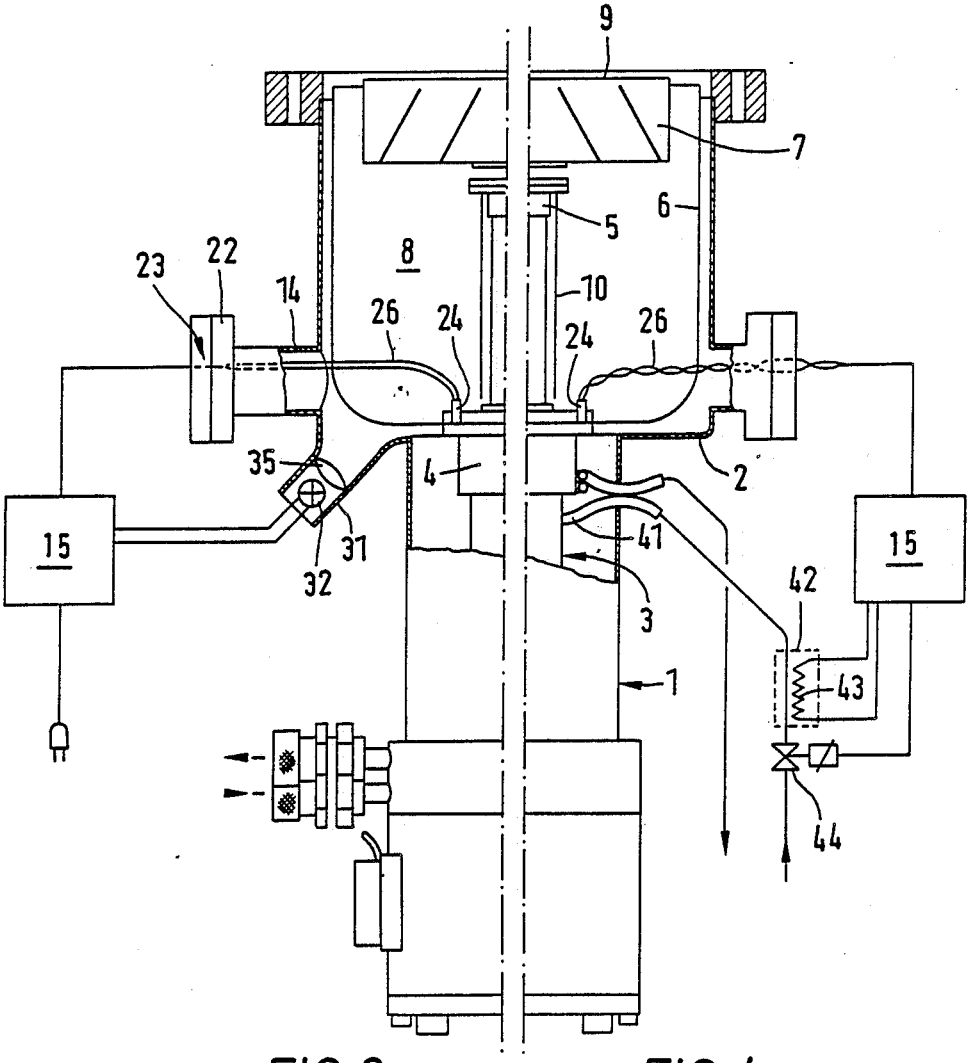
FIGS. 3–8 are schematic, side sectional views similar to FIG. 1, and partially broken away, of additional embodiments of the cryopump according to the invention.

In the embodiment according to FIG. 3, counter-heating of the first stage is effected by heat radiating onto a section of shield 6. For this purpose, housing 2 of cryopump 1 is equipped with a further pipe connection 31. This pipe connection includes a radiation source 32 which may be, for example, a high energy light source or the like. By means of a suitable optical system 35 whose mount simultaneously constitutes the vacuum-tight seal of the interior 8 of housing 2, the radiation emanating from the radiation source is concentrated on the external surface of pump surface 6 which is advisably blackened at this location. To control the radiated energy, a temperature sensor 24 is provided at cooling stage 4 and furnishes its measured values to monitoring device 15. There, a comparison is made with the set desired temperature value. Accordingly, radiation source 32 is switched on and off or its light output is regulated. The expediency of this solution is that voltage carrying lines need not be installed in the interior of the cryopump.

FIG. 4 shows an embodiment in which cooling stage 4 is equipped with a heat exchanger, here in the form of a coiled tube 41. Warm gas, for example from the helium circuit of the refrigerator, can be conducted through this coiled tube to counter-heat cooling stage 4. An external heat exchanger 42 equipped with an electrical heating device 43 supplied by monitoring device 15 serves to heat this gas. This heat exchanger, together with a valve 44, lies in the gas intake line. This arrangement permits two ways of proceeding for setting the temperature of cooling stage 4. Either, the gas stream can be regulated if valve 44 is configured as a dosage regulating valve. Another possibility is to supply a constant stream of gas and to raise the temperature of the gas in a controlled manner by means of the heat exchanger.

Figures 5, 6:
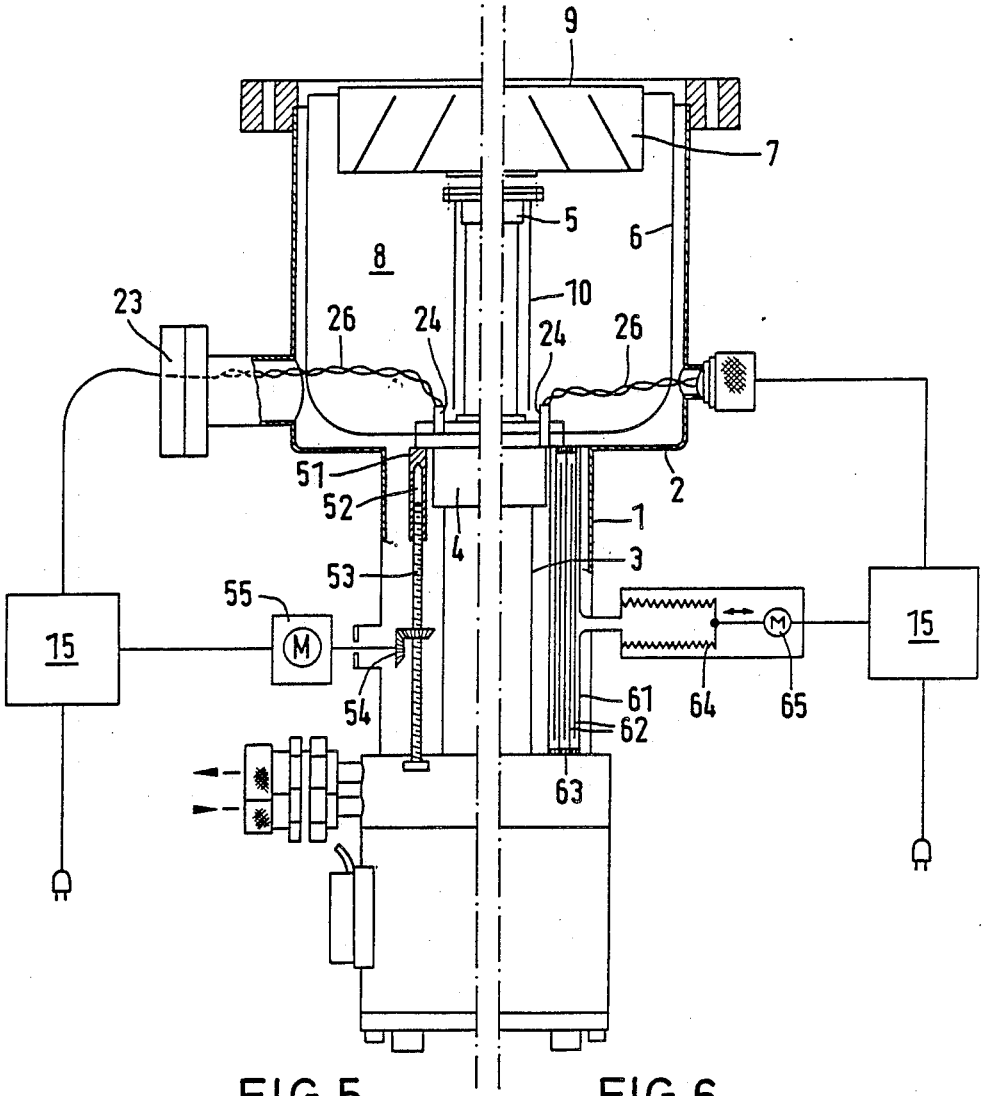

In the embodiment of FIG. 5, a component 51 is fastened to cooling stage 4 which includes a downwardly oriented threaded bore 52. A rod 53 can be screwed into this threaded bore 52, with the free end of the rod being at room temperature or being heated. The screw thread forms a heat exchange surface whose size can be regulated by changing the depth to which the rod is screwed in. With the aid of a gear system 54 and a motor 55, the screw-in depth can be regulated. The motor, in turn, is controlled by control unit 15 which receives the values furnished by temperature sensor 24. In an appropriate manner, the screw thread is encapsulated or protected by an inert gas atmosphere relative to the vacuum chamber in order to avoid contamination.

FIG. 6 shows a solution in which a plate system 61 is connected with cooling head 4 as well as with a warm location. Plates 62 are alternatingly connected with cooling head 4 and with the warm location 63. The variation of heat transfer for the purpose of keeping a constant desired temperature is effected by a variation in the gas fill pressure in that, if the temperature is too low, the fill pressure in plate system 61 is increased. The fill pressure can be generated with the aid of a bellows 64 and a motor 65, with motor 65, in turn, being controlled as a function of the values furnished by sensor 24.

Figures 7, 8:
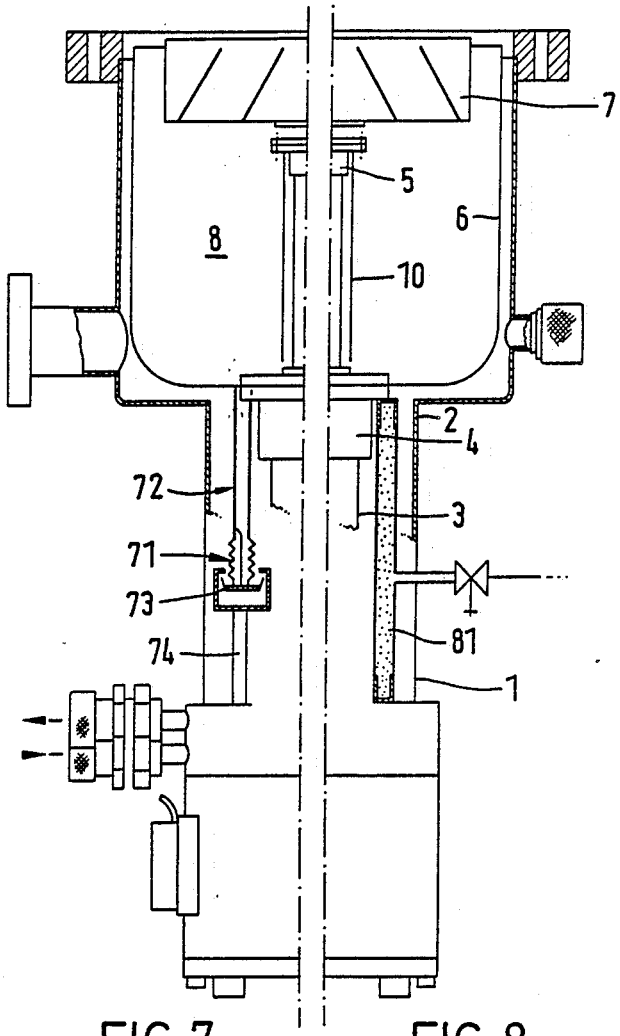

In the embodiment FIG. 7, a heat flow switch 71 is provided. It includes hollow rod 72 which is connected with cooling stage 4 contains gas. The gas expands or contracts depending on temperature of the bellows fastened to the lower of the rod. The plunger 73 of the bellows is associated rod 74 which is connected with a warm location. The contact of the heat flow switch is actuated by expansion or contraction of the gas in rod 72. Instead of a bellows, a suitable bimetal element or a suitable magneto- or electrostrictive element may also be provided.

In the cryopump according to FIG. 8, a hollow rod 81 filled with a suitably selected gas is disposed between cooling stage 4 and a warm location. This gas is advisably the gas to be pumped with preference under increased pressure. The gas is condensed in the region of cooling stage 4, then flows downwardly and evaporates again in the region of the warm location. This circuit produces a load on cooling stage 4. This load can be set by way of the pressure or, preferably, by the selection of suitable gases.

What is claimed is:

1. Method of adapting a two-stage refrigerator cryopump to a specific gas which has a given vapor temperature corresponding to a vapor pressure curve for the specific gas at a maximum process pressure; the cryopump including a first cooling stage to which first pump surfaces are fastened; the cryopump further including a second cooling stage to which second pump surfaces are fastened and which, during operation, takes on a temperature of up to 20 degrees K., comprising the steps of:

providing a heating device for heating said first cooling stage;

controlling said heating device such that the coldest location of said first cooling stage has a temperature which is higher by 5 degrees K. to 10 degrees K. than said vapor temperature of said specific gas associated with said maximum process pressure.

2. A two-stage refrigerator cryopump which has a maximum process pressure and which is adaptable to a specific gas which has a given vapor temperature corresponding to a vapor pressure curve for the specific gas at the maximum process pressure, comprising:

a first cooling stage having first pump surfaces and a heating means;

a second cooling stage having second pump surfaces and which operates in a temperature range of up to 20 degrees K., wherein said first cooling stage includes a temperature sensor means for sensing a temperature in said first cooling stage and producing an output signal representing said temperature, and further comprising a control unit means for comparing the signal furnished by said temperature sensor with said given vapor temperature and for controlling said heating device such that the coldest location of said first cooling head has a temperature which is higher by 5 degrees K. to 10 degrees K. than said vapor temperature.

3. Cryopump according to claim 2, further comprising a housing containing said first and second cooling stages and a radiation source controlled by said control unit and a pipe connection disposed at said housing, said radiation source being accommodated in said pipe connection.

4. Cryopump according to claim 3, further comprising an optical system disposed between said radiation source and one of said first and second pump surfaces.

5. Cryopump according to claim 2, wherein said first cooling stage further comprises a heat exchanger.

6. Cryopump according to claim 2, wherein said first cooling stage includes a component having a threaded bore and a rod having a warm end, in which said rod can be screwed into said threaded bore to a selected depth.

7. Cryopump according to claim 2, further comprising a plate system having a plurality of plates, said plate system being pressurizable by gas and being associated with said first cooling stage, said plurality of plates being alternatingly connected with said cooling head and with a heat source, said plate system further comprising a means for setting a gas fill pressure of said plate system.

8. Cryopump according to claim 2, further comprising a mechanical heat flow switch means associated with said first cooling stage for connecting said first cooling stage with a source of heat or interrupting said connection, depending upon a state of said switch means.

9. Cryopump according to claim 8, wherein said heat flow switch is actuated by pressure of a gas enclosed in a cylinder or bellows, wherein contraction of said gas upon cooling actuates a contact of said heat switch.

10. Cryopump according to claim 2, wherein said heating device comprises a gas-filled, closed heat transporting rod in which a suitably selected gas is disposed which circulates in said tube in such a manner that it condenses into a liquid at a cold location and flows back from said cold location to a warm location and, due to this circulation, produces a load on said first cooling stage.

11. Cryopump according to claim 10, wherein said gas in said heat transporting rod is the same as said specific gas which is to be pumped.

* * * * *